United States Patent [19]

Kubr et al.

[11] Patent Number: 4,493,768

[45] Date of Patent: Jan. 15, 1985

[54] TWIN PUSHER CENTRIFUGE INCLUDING ROTATABLE PUSHER

[75] Inventors: Vaclav Kubr, Oberengstringen; Bruno Mülhaupt, Schlieren; Hansjoachim Paschedag, Männedorf, all of Switzerland

[73] Assignee: Sulzer-Escher Wyss Ltd., Zurich, Switzerland

[21] Appl. No.: 527,563

[22] Filed: Aug. 29, 1983

[30] Foreign Application Priority Data

Sep. 6, 1982 [CH] Switzerland ..... 5278/82

[51] Int. Cl.[3] ..... B04B 3/02

[52] U.S. Cl. ..... 210/360.2; 210/374; 210/380.3; 494/58

[58] Field of Search ..... 210/360.1, 374, 375, 210/376, 369, 372, 360.2, 396, 397, 380.3, 394, 403, 364, 365, 366, 367, 370, 371, 377, 378; 209/250, 296, 385; 494/56, 58

[56] References Cited

U.S. PATENT DOCUMENTS 1,795,495 3/1931 Lavett ..... 210/374
3,007,576 11/1961 Hannaford ..... 209/296
3,754,660 8/1973 Cottrell ..... 210/374

FOREIGN PATENT DOCUMENTS

K 24213 10/1956 Fed. Rep. of Germany ..... 210/374
1065333 9/1959 Fed. Rep. of Germany ..... 210/374

*Primary Examiner*—Richard V. Fisher
*Assistant Examiner*—W. Gary Jones
*Attorney, Agent, or Firm*—Werner W. Kleeman

[57] ABSTRACT

The twin pusher centrifuge comprises a sieve or filter drum having discharge openings on both sides thereof. At the center of the sieve or filter drum there is provided a pusher rotating at a rotational speed which differs from the rotational speed of the sieve or filter drum. The pusher contains pushing surfaces which are inclined at an angle relative to the direction of product movement. Product infeed pipes open to the rear of the pushing surfaces. These pushing surfaces are alternatingly positioned at opposite inclinations or comprise two pushing surfaces directed at opposite inclinations with respect to one another. Due to such an arrangement the product which is infed to the center of the sieve or filter drum is pushed from such center or central region of the drum towards both sides thereof in the direction of the discharge openings. An energy-saving and jerk-free operation of the centrifuge is thus obtained while employing a particularly simple construction of centrifuge.

9 Claims, 8 Drawing Figures

TWIN PUSHER CENTRIFUGE INCLUDING ROTATABLE PUSHER

CROSS-REFERENCE TO RELATED APPLICATIONS

This application is related to our commonly assigned, copending U.S. application Ser. No. 06/527,564, filed Aug. 29, 1983, entitled "TWIN PUSHER CENTRIFUGE", and the commonly assigned, copending U.S. application, Ser. No. 06/378,833, filed May 17, 1982, and entitled "CENTRIFUGAL SEPARATOR".

BACKGROUND OF THE INVENTION

The present invention relates to a new and improved construction of twin pusher centrifuge.

In its more specific aspects the present invention relates to a new and improved twin pusher centrifuge comprising a sieve or filter drum which is rotatable about its lengthwise axis at a predetermined rotational speed. The sieve or filter drum is provided with a product infeed and product discharge outlets or openings at both its opposite sides or ends. Approximately at the center or central region of the sieve or filter drum there is arranged a pushing device or pusher which is rotatable about the lengthwise axis of the sieve or filter drum at a rotational speed which is different from the rotational speed of such sieve or filter drum. The pusher serves to simultaneously convey the product which has been infed via the product infeed into the sieve or filter drum in the direction of both of the product discharge outlets or openings.

In a pusher centrifuge as known, for example, from U.S. Pat. No. 2,232,770, granted Feb. 25, 1941, a planar pusher or thrust floor member is mounted normally relative to the lengthwise axis of the sieve or filter drum and is periodically reciprocated in axial direction. Due to the oscillating reciprocation or to-and-fro movement of the pusher or thrust floor member the product which is infed via the product infeed close to the pusher floor member is periodically pushed in the direction towards the product discharge or outlet. Continuous operation of the centrifuge is thus possible. However, a complicated and expensive mechanical or hydraulic system is required for the periodic reciprocation of the pusher floor member. Considerable energy is consumed for displacing the masses which does not benefit the separating operation during centrifuging. Furthermore, the mass forces cause an unsteady or noisy operation of the centrifuge and exert a high load upon the bearings. Additionally, the movement of the pusher floor member in only one direction is utilized for pushing-out the product.

In a further construction of pusher centrifuge as known, for example, from U.S. Pat. No. 2,232,769, granted Feb. 25, 1941, the last-mentioned disadvantage is eliminated by arranging two sieve or filter drums so as to face each other on the side of their pusher floor members. A mechanical or hydraulic system is arranged between the two sieve or filter drums and simultaneously acts upon the two pusher floor members. The product contained in one sieve or filter drum is displaced in a direction towards the product discharge during one phase of the operation while the product contained in the other sieve or filter drum is displaced in a direction towards the product discharge during the other phase of the operation. However, the other disadvantages which are caused by the reciprocation of masses are equally not eliminated in this arrangement.

In a further development of such a pusher centrifuge as known, for example, from German Pat. No. 1,151,468, granted Feb. 6, 1964, a twin pusher centrifuge contains only one sieve or filter drum and a pusher floor member which is arranged at the center of the sieve or filter drum and which is reciprocated. Also, in this case the energy-consuming reciprocation of masses and an unsteady or noisy operation cannot be avoided. Further disadvantages of such prior art construction are that separate product infeeds are provided for the two sides of the pusher floor member. The infeed to the centrifuge thus is simultaneously effected on two opposite sides, however, by using separate infeeds which complicates the construction of the centrifuge and makes the same expensive. Additionally, it is not possible to ensure that the infeed of the product on the two sides always remains exactly the same, which creates disturbing asymmetries and requires an expensive regulation of the infeed of the product. Furthermore, it can be disadvantageous when processing certain products that the product has to be continuously infed, in order not to cause any return pressure shocks. In the case of certain products which are difficult to process, there thus exists the danger of flooding of the centrifuge if there are not available sufficiently long intermediate periods for separation of the fluid which is close to the pusher floor member and further product is continuously supplied.

SUMMARY OF THE INVENTION

Therefore, with the foregoing in mind it is a primary object of the present invention to provide a new and improved construction of a twin pusher centrifuge which is not associated with the aforementioned limitations and drawbacks of the prior art constructions.

Another important object of the present invention aims at providing a new and improved twin pusher centrifuge which has an increased output but at the same time has a simpler and less expensive construction.

Still a further significant object of the present invention is directed to a new and improved construction of a twin pusher centrifuge which consumes less energy.

Another very important object of the present invention is directed to a new and improved construction of a twin pusher centrifuge which has a quieter operation than the prior art constructions.

Another important object of the present invention is directed to a new and improved construction of a twin pusher centrifuge which operates with a substantially uniform product infeed without incurring the danger of flooding or swamping of the centrifuge.

Now in order to implement these and still further objects of the invention, which will become more readily apparent as the description proceeds, the twin pusher centrifuge of the present development is manifested by the features that, the pusher comprises pushing surfaces which extend at an inclination with respect to the lengthwise axis of the sieve or filter drum and with respect to the circumferential direction of the sieve or filter drum. These pushing surfaces are arranged and directed such that at least one respective pushing surface displaces the product which is located on the inside of the sieve or filter drum in one direction and at least one respective pushing surface displaces the product located on the inside of the sieve or filter drum in the other, opposite direction when the pusher is rotated relative to the sieve or filter drum. The product infeed or product supply means comprises at least one infeed pipe or the like which opens to the rear of one of the pushing surfaces viewed in the direction of movement of such pushing surfaces and which infeed pipe synchronously rotates with the related pushing surface.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components, and wherein.

DETAILED DESCRIPTION OF THE PREFERRED EMBODIMENTS

Figure 1:
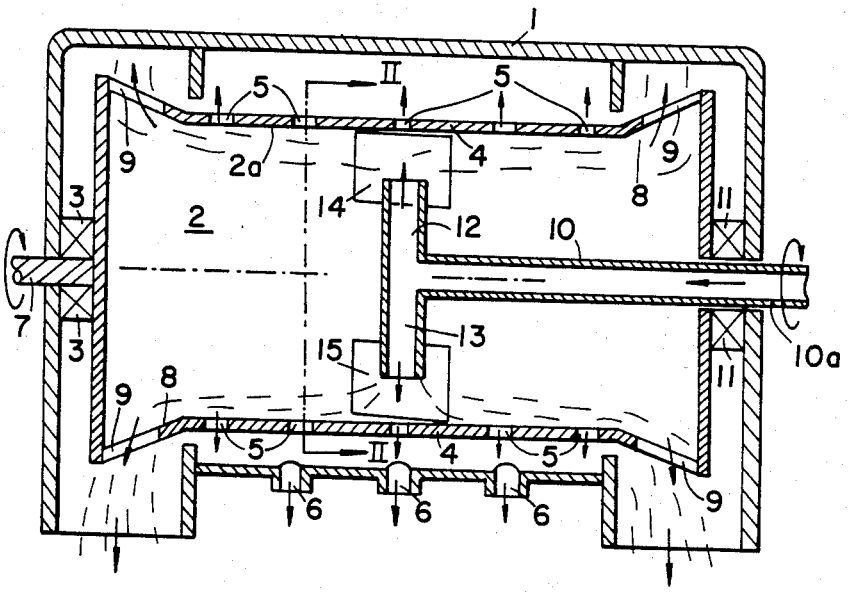
FIG. 1 is a sectional view of a first exemplary embodiment of twin pusher centrifuge constructed according to the invention.

Describing now the drawings, it is to be understood that only enough of the construction of the various exemplary embodiments of twin pusher centrifuge has been shown as needed for those skilled in the art to readily understand the underlying principles and concepts of the present development, while simplifying the showing of the drawings. Turning attention now specifically to FIG. 1, there has been illustrated in section therein a first exemplary embodiment of twin pusher centrifuge according to the invention. A rotatable sieve or filter drum 2 is arranged within a housing 1 and is rotatably journaled or mounted relative to the housing 1 by means of bearings 3. The sieve or filter drum 2 comprises a shell or jacket 4 which largely is designed as a cylinder. This substantially cylindrical shell or jacket 4 is provided with a multitude of openings 5 for the passage of centrifuged fluid which is discharged from the twin pusher centrifuge through openings or ports 6 provided in the housing 1. The sieve or filter drum 2 is driven at a predetermined rotational speed and placed into rotation by means of an appropriately driven shaft 7. A respective conical end portion 8 is contiguous to the substantially cylindrical central portion of the shell or jacket 4 of the sieve or filter drum 2 and these conical end portions 8 are each provided with a product discharge outlet or opening 9.

The product is infed or inputted via a product infeed or supply means **10*a* comprising a hollow shaft 10 which is rotatably journaled or mounted in the housing 1 by means of bearings 11. The product infeed or supply means 10*a* further comprises, approximately at the center or central region of the sieve or filter drum 2, two infeed pipes or conduits 12 and 13 or equivalent structure attached to the hollow shaft 10 in the manner of spokes which are here directed in opposite directions. The product is thus continuously supplied at the center or central region of the sieve or filter drum 2 to the inner wall 2*a* thereof. The appropriately driven hollow shaft 10 and the infeed pipes 12 and 13 rotate at a rotational speed which is different from the rotational speed of the sieve or filter drum 2. The difference in the rotational speeds is advantageously selected in dependence upon the properties of the product to be processed. There is also provided a pusher forming pushing surfaces 14 and 15. The pushing surfaces 14 and 15 are inclined relative to the direction of movement, i.e. with respect to the circumferential line or circumference of the sieve or filter drum 2. The pushing surfaces 14 and 15 are each arranged forwardly of their related infeed pipe 12 and 13, respectively, in order to uniformly convey the product which has been supplied via the product infeed 10*a* to the center of the sieve or filter drum 2 towards the discharge outlets or openings 9 which are provided at the two ends or end regions of the sieve or filter drum 2. Both the pushing surfaces 14 and 15 are solidly or fixedly connected to either the related infeed pipe 12 and 13 or to the hollow shaft 10, and thus, synchronously rotate with the product infeed. While the one pushing surface 14 is directed and arranged such that the product is displaced by the action thereof to one side, in the illustrated embodiment towards the right, the other pushing surface 15 is exactly oppositely directed or oriented, so that the product is conveyed by the action thereof in the opposite direction, in the illustrated embodiment towards the left. Since an infeed pipe 12 and 13 opens to the rear of the related pushing surfaces 14 and 15 as seen in the direction of rotational movement, the area of the inner wall 2*a* of the sieve or filter drum 2 which has been freed by the action of the pushing surfaces 14 and 15 is immediately again covered by the product to be processed. There is some intermittent period of time available for separating the fluid from the product until the next-following or trailing pushing surface passes over the corresponding location at the sieve or filter drum 2** and further product is supplied thereto. Swamping or flooding of the centrifuge thus can be effectively avoided by suitably selecting the mutual spacing of the pushing surfaces from one another.

Figure 2:
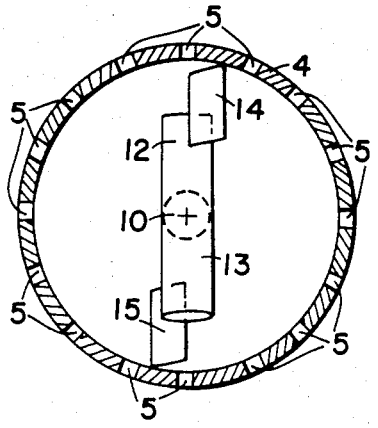
FIG. 2 is a section through the centrifuge shown in FIG. 1, taken substantially along the line II—II thereof.

In principle, there can be used any optionally desired number of infeed pipes and pushing surfaces. While two infeed pipes 12 and 13 and two associated pushing surfaces 14 and 15 are shown in FIG. 2 for the first exemplary embodiment of twin pusher centrifuge according to the invention, there are shown four infeed pipes 16, 17, 18, 19 and four associated pushing surfaces 20, 21, 22, 23 in the second exemplary embodiment of the inventive twin pusher centrifuge which is illustrated in section in FIG. 3 of the drawings. Once again the infeed pipes and related pushing surfaces are arranged at regular angular intervals or spacing from one another at the hollow shaft of the product infeed or supply means in the manner of spokes of a wheel.

Advantageously, the number of pushing surfaces and their difference in rotational speed relative to the rotatable sieve or filter drum 2 are adapted to the product to be processed. However, for reasons of balance and for achieving a quieter operation an even number of infeed pipes and pushing surfaces is particularly advantageous.

Figure 3:
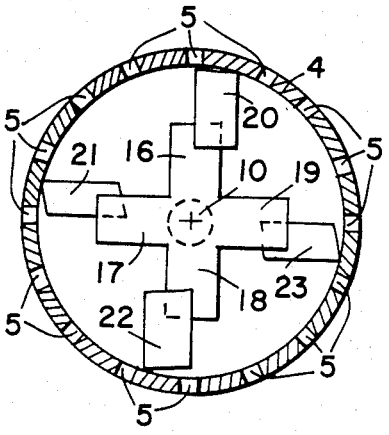
FIG. 3 is a sectional view, corresponding to that of FIG. 2, of a second exemplary embodiment of twin pusher centrifuge according to the invention.
Figure 4:
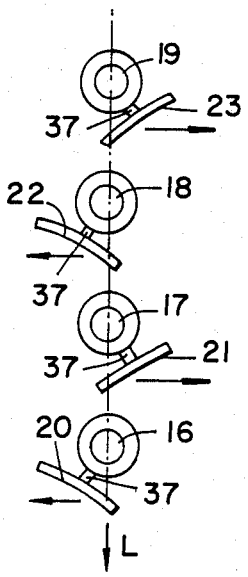
FIG. 4 is a schematic view of the pushing surfaces and the product infeed pipes viewed along the circumference of the sieve drum of the twin pusher centrifuge shown in FIG. 3.

In FIG. 4 the arrangement of the infeed pipes 16, 17, 18, 19 and their associated pushing surfaces 20, 21, 22, 23 in the embodiment as illustrated in FIG. 3 is shown in their direction of movement along a straightened circumferential line L of the sieve or filter drum 2 i.e., in a development view. The pushing surfaces 20, 21, 22, 23 are alternatingly directed in opposite directions and extend at an angle relative to the circumferential line L. The product is thus conveyed in an opposite direction by each pushing surface which trails or follows a preceding or leading pushing surface.

As shown in FIG. 4, the pushing surfaces 20, 21, 22, 23 can be mounted to the infeed pipes 16, 17, 18, 19 by means of flexible elements 37. During operation, therefore, the outer edges of the pushing surfaces 20, 21, 22, 23 contactingly engage the inner wall 2*a* of the sieve or filter drum 2 due to centrifugal force or to elasticity and thus provide for a good sealing action.

Figure 5:
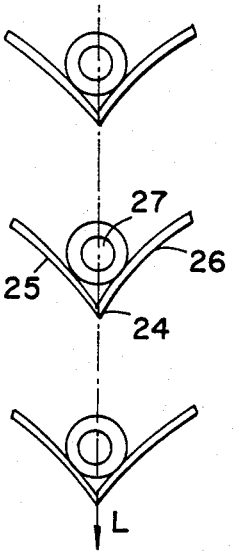
FIG. 5 is a sectional view of an arrangement of twin pushing surfaces and product infeed pipes viewed along the circumference of a sieve drum according to a third exemplary embodiment of the twin pusher centrifuge according to the invention.

A third embodiment of the twin pusher centrifuge according to the invention is illustrated in FIG. 5 in a manner which is similar to the illustration of the second embodiment in FIG. 4. Here, the pusher comprises a number of pushing surfaces 25 and 26 which are arranged at opposite inclinations and abut one another at an edge 24. The associated infeed pipe 27 opens into the angle or apex region at the edge 24 to the rear of the two pushing surfaces 25, 26 as seen in the direction of movement. By using a pusher designed in this manner the product is simultaneously conveyed in the two opposite directions towards the discharge outlets 9 when the pushing surfaces 25, 26 pass over the inner wall 2*a* of the sieve or filter drum 2. Consequently, with this embodiment any asymmetry is avoided, so that such construction of twin pusher centrifuge has an extremely quiet operation even if an uneven number of pushers is selected.

Figure 6:
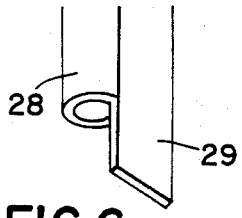
FIG. 6 is a fragmentary perspective view of a product infeed pipe with an integrated pushing surface according to a fourth exemplary embodiment of a twin pusher centrifuge according to the invention.

A fourth embodiment of the inventive twin pusher centrifuge is illustrated in FIG. 6 which depicts a further development of the infeed pipe-pushing surface configuration shown in FIG. 4. In this embodiment the pushing surface 29 forms a front surface at the associated infeed pipe 28.

Figure 7:
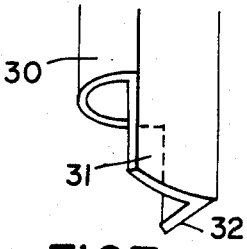
FIG. 7 is a fragmentary perspective view of a product infeed pipe with integrated twin pushing surfaces according to a fifth exemplary embodiment of the twin pusher centrifuge according to the invention.

In the fifth embodiment of twin pusher centrifuge according to the invention as illustrated in FIG. 7 an infeed pipe 30 is provided at its front end with two inclined but oppositely directed pushing surfaces 31 and 32 which form a roof-edge or gable-like arrangement. This embodiment thus will be seen to constitute a further development of the arrangement illustrated in FIG. 5.

Figure 8:
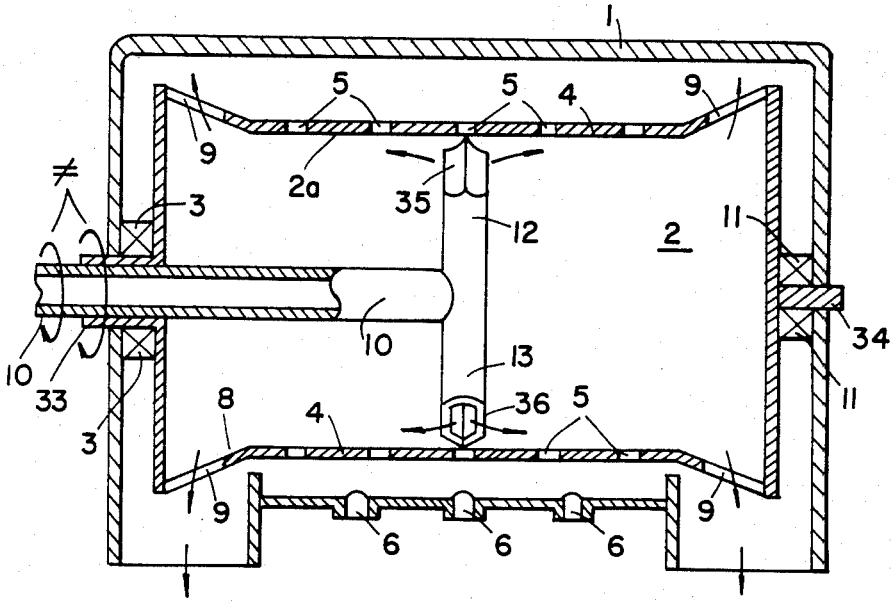
FIG. 8 is a sectional view of a sixth exemplary embodiment of twin pusher centrifuge constructed according to the invention.

It may be noted that modifications of the herein disclosed exemplary constructions of twin pusher centrifuge are possible without departing from the spirit and scope of the inventive concepts and teachings. Thus, for example, the drive of the sieve or filter drum 2, that of the product infeed 10*a* and that of the pusher may be effected only on one side, instead of on two opposite sides as shown in the arrangement of FIG. 1. In such case the drive shaft then is advantageously constructed as a hollow drive shaft 33 and the hollow shaft 10 of the product infeed 10*a* is arranged in the interior of the hollow shaft 33. Such a design is depicted for the sixth embodiment of the inventive twin pusher centrifuge which is shown in sectional view in FIG. 8. The hollow shaft 10 of the product infeed 10*a* is here drivingly connected to the hollow drive shaft 33 by means of a conventional speed-reduction or step-down gearing (not shown) which results in a relatively simple construction and in a quiet operation of the centrifuge. The other side or end of the sieve or filter drum 2 is rotatably mounted by means of a journal or pin 34 in the associated bearing 11. The infeed pipes 12 and 13 are arranged to form a roof-edge configuration at their front sides 35 and 36 in a manner corresponding to the arrangement illustrated in FIG. 7. Also the shape of the sieve or filter drum 2 can be selected to deviate from the embodiments shown in accordance with the prevailing requirements.

In each case there is achieved the beneficial result that the various embodiments of herein disclosed pusher centrifuges according to the invention do not contain any reciprocated or to-and-fro moved masses, rather only rotary movements are contemplated. Therefore no energy is required for accelerating and decelerating masses and the operation of the centrifuge is entirely jerk-free. Also the infeed of the product is continuously effected, so that no return pressure shocks occur. During the infeed the product does not impact against any edges, so that spraying or spattering thereof within the sieve or filter drum 2 is essentially prevented. A certain dewatering time period or interval is available to the product fed into the sieve or filter drum 2 until it is pushed-on or displaced, so that also products or materials which are difficult to process can be centrifuged without the danger of flooding or swamping the centrifuge. The aforementioned advantages are achieved by designing the centrifuge according to the teachings of the invention so as to possess an extremely simple and economical construction.

While there are shown and described present preferred embodiments of the invention, it is to be distinctly understood that the invention is not limited thereto, but may be otherwise variously embodied and practiced within the scope of the following claims.

Accordingly, what we claim is:

1. A twin pusher centrifuge comprising:

a rotatable sieve drum having a lengthwise axis and two oppositely situated end portions;

means for rotating said sieve drum about said lengthwise axis at a predetermined rotational speed;

a product infeed for infeeding a product to be processed into the inside of said sieve drum;

said sieve drum being provided with product discharge outlets at said two end portions;

a pusher arranged approximately centrally within said sieve drum and means for rotating said pusher about said lengthwise axis of said sieve drum at a rotational speed which is different from said rotational speed of said sieve drum, in order to simultaneoulsy convey the product infed into said sieve drum by said product infeed in respective directions extending towards both of said product discharge outlets;

said pusher comprising at least one first pushing surface extending at a first inclination relative to said lengthwise axis and the circumferential direction of said sieve drum and being directed towards the product discharge outlet of a first one of said two end portions of the sieve drum;

said pusher further comprising at least one second pushing surface extending at a second inclination relative to said lengthwise axis and the circumferential direction of said sieve drum and being directed to the product discharge outlet at a second one of said two end portions of the sieve drum;

said product infeed comprising infeed pipes each of which is connected to a related one of said at least one first and second pushing surfaces;

each one of said infeed pipes opening to the rear of the related one of said at least one first pushing surface and said at least one second pushing surfaces with respect to the related one of said two end portions and synchronously rotating with said related one of said at least one first pushing surface and second pushing surface; and said at least one first pushing surface being arranged such that said at least one first pushing surface displaces said product at the inside of said sieve drum in a direction towards the product discharge outlet at the first one of said two end portions of the sieve drum and that said at least one second pushing surface displaces said product at said inside of said sieve drum in an opposite direction towards the product discharge outlet at the second one of said two end portions of the sieve drum, when said pusher is rotated relative to said sieve drum.

2. The twin pusher centrifuge as defined in claim 1, wherein:

said pushing surfaces are alternatingly directed towards different ones of said two end portions such that said at least one first pushing surface is directed towards said first one of said two end portions and at least one successive second pushing surface is directed towards the second one of said two end portions.

3. The twin pusher centrifuge as defined in claim 1, wherein:

said pusher comprises at least two of said first and second pushing surfaces abutting one another at edges thereof;

said first pushing surface being directed towards said first one of said two end portions and said second pushing surface being directed towards the said second one of said two end portions.

4. The twin pusher centrifuge as defined in claim 1, wherein:

said first and second pushing surfaces include front surfaces projecting from the related one of said infeed pipes.

5. The twin pusher centrifuge as defined in claim 1, wherein:

said product infeed further comprises a hollow shaft for infeeding said product; and said pushing surfaces and the related ones of said infeed pipes being configured and arranged to form substantially radially extending spokes at said hollow shaft.

6. The twin pusher centrifuge as defined in claim 5, wherein:

said substantially radially extending spokes are arranged at a substantially uniform angular spacing from one another.

7. The twin pusher centrifuge as defined in claim 6, wherein:

an even number of said spokes is provided.

8. The twin pusher centrifuge as defined in claim 1, further including:

flexible mounting means for mounting said pushing surfaces at the related ones of said infeed pipes.

9. The twin pusher centrifuge as defined in claim 1, wherein:

said product infeed constitutes a single common infeed means for the product to be processed in the centrifuge; and said infeed pipes of said single common infeed means opening to opposite sides of the pusher.

* * * * *

UNITED STATES PATENT AND TRADEMARK OFFICE

CERTIFICATE OF CORRECTION

PATENT NO. : 4,493,768

DATED : January 15, 1985

INVENTOR(S) : VACLAV KUBR et al

It is certified that error appears in the above-identified patent and that said Letters Patent is hereby corrected as shown below:

Column 4, line 33, please delete "regions" and insert --portions--

Column 6, line 61, please delete "simultaneoulsy" and insert --simultaneously--

Signed and Sealed this

*Sixteenth* Day of *July 1985*

[SEAL]

*Attest:*

DONALD J. QUIGG

*Attesting Officer* *Acting Commissioner of Patents and Trademarks*